US006393099B1

(12) United States Patent
Miller

(10) Patent No.: US 6,393,099 B1
(45) Date of Patent: May 21, 2002

(54) STATIONARY ANODE ASSEMBLY FOR X-RAY TUBE

(75) Inventor: Robert Steven Miller, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/409,998

(22) Filed: Sep. 30, 1999

(51) Int. Cl.[7] ..... H01I 35/08
(52) U.S. Cl. ..... 378/143; 378/119; 378/121
(58) Field of Search ..... 378/143, 138, 378/129, 125, 119, 121, 124, 126, 137

(56) References Cited

U.S. PATENT DOCUMENTS 2,186,380 A * 9/1940 Hirsch
2,242,812 A * 5/1941 Brown
4,336,476 A * 6/1982 Holland et al. ..... 313/60
5,768,338 A * 6/1998 Kuroda et al. ..... 378/143
6,163,593 A * 12/2000 Koller et al. ..... 378/144

* cited by examiner

*Primary Examiner*—Robert H. Kim
*Assistant Examiner*—Hoon K. Song
(74) *Attorney, Agent, or Firm*—Workman, Nydegger & Seeley

(57) ABSTRACT

The present invention relates to an x-ray tube that utilizes a stationary anode assembly. The stationary anode assembly includes an anode target portion that is disposed on the target end of an anode substrate. The anode target includes an overhang portion, that functions to prevent rebounding electrons from striking the underlying anode substrate that would otherwise result in the production of errant x-rays, and that also functions to block errant x-rays produced at the substrate from exiting the x-ray tube. Embodiments also include an anode target having a target surface that is formed with a contoured shape that functions to direct any rebounding electrons towards the center of the anode target surface, and away from the underlying anode substrate. The present invention is particularly useful in preventing a secondary electron stream from emitting errant x-rays that would compromise the particular quality of the x-ray that the x-ray device is designed to generate.

17 Claims, 7 Drawing Sheets

STATIONARY ANODE ASSEMBLY FOR X-RAY TUBE

BACKGROUND OF THE INVENTION

1. The Field of the Invention

The present invention relates to stationary anode assemblies used in certain types of x-ray tubes. In particular, the present invention relates to a stationary target anode that improves the quality and intensity of the x-ray signal generated by the x-ray tube.

2. The Relevant Technology

X-ray producing devices are extremely valuable tools that are used in a wide variety of applications, both industrial and medical. Such equipment is commonly used in areas such as diagnostic and therapeutic radiology; semiconductor manufacture and fabrication; and materials testing.

The basic operation for producing x-rays in the equipment used in these different industries and applications is very similar. X-rays, or x-radiation, are produced when electrons are produced and released, accelerated, and then stopped abruptly. Typically, this entire process takes place in a vacuum formed within an x-ray generating tube. An x-ray tube ordinarily includes three primary elements: a cathode, which is the source of electrons; an anode, which is spaced apart from the cathode and oriented so as to receive electrons emitted by the cathode; and some mechanism for applying a high voltage for driving the electrons from the cathode to the anode.

The three elements are usually positioned within an evacuated tube, and connected within an electrical circuit. The electrical circuit is connected so that the voltage generation element can apply a very high voltage (ranging from about five thousand to in excess of hundreds of thousands of volts) between the anode (positive) and the cathode (negative). The high voltage differential causes a stream, or beam, of electrons to be emitted at a very high velocity from the cathode towards an anode target portion of the anode assembly. The anode target typically is comprised of a metal so that when the electrons strike the target, the kinetic energy of the striking electron beam is converted to electromagnetic waves of very high frequency, i.e., x-rays. The characteristics of the x-rays that are produced, for instance wavelength, depend on the type of metal used for the anode target material. Different metals will produce x-rays having different characteristics. The resulting x-rays emanate from the anode target, and are then collimated onto an object, such as an area of a patient's body or an industrial device. As is well known, the x-rays that pass through the object, or that fluoresce from the object, can be detected and analyzed so as to be used in any one of a number of applications, such as x-ray medical diagnostic examination or material analysis procedures.

In some x-ray devices, the anode target is positioned on a rotary disk that rotates during operation. Rotation of the anode target reduces the amount of heat present at a particular point on the target at any given time. Other x-ray tubes however, for example certain types used in devices for analytical work such as x-ray fluorescence and x-ray diffraction, use a stationary target anode assembly.

FIG. 1 illustrates one example of a portion of an x-ray tube device 8 that utilizes a stationary anode assembly 10. The stationary anode assembly 10 includes an anode substrate 12 portion, and an anode target 14 that is affixed to the target end 16 of the substrate 12 by a brazing interface 18 or the like. X-ray tube device 8 also includes a cathode assembly, shown as comprising a shield 24 and a filament 25. In operation, an electrical current is passed through the filament 25, which heats up and then discharges a cloud of electrons. As noted, a large voltage potential is placed between the cathode and the anode, which causes the electrons to accelerate to extremely high speeds towards the anode. When the accelerating electrons impinge upon the surface 20 of anode target 14, x-rays are produced, schematically represented at lines 26. Preferably, the x-rays 26 are directed through a window 28 formed on the x-ray tube device 8 and towards an x-ray subject.

The generation of quality x-rays is dependent on several factors, including the type of materials used on the anode target 14, and the physical orientation of the anode target with respect to the cathode. For example, the anode target layer 14 is made from a metallic material having a specific atomic number (Z), which is capable of efficiently generating x-rays when impinged with the high velocity electron stream. In contrast, the underlying anode substrate 12 portion is typically constructed of a different type of metal than the target. For example, copper is often used as a substrate. The selection of this substrate material is based upon several factors. First, its ability to efficiently conduct and dissipate the heat created at the anode target 14 as a result of the impinging electrons is important. Second, the substrate material used is often different from the target material due to the fact that target materials are typically very expensive, and are difficult to machine and manufacture. Thus, use of a different material in the substrate is usually more practical. However, use of a different material for the substrate can give rise to other problems. For instance, the substrate material will emit characteristic x-rays that are different from those emitted from the target. As such, if the anode substrate is impinged with electrons, it is typically a contaminating source of x-rays that can adversely interfere with the x-rays emitted from the target. The x-rays that are emitted from a substrate can be destructive in other ways as well. For instance, in an x-ray fluorescence device, x-rays must be produced from an anode target material that is different from the type of material being analyzed, or the resulting analysis would be inconclusive. Thus, if the substrate material is the same as the material being analyzed, any x-rays generated at the substrate would be destructive.

Generating x-rays that have a specific and consistent wavelength and intensity also requires that the cathode be oriented with respect to the anode target 14 in an appropriate manner. For instance, the filament 25 must be positioned relative to the anode assembly 10 in a manner so that the electrons within the electron stream strike the anode target and thereby generate x-rays. At the same time, the distance (denoted as "s" in FIG. 1) between the stationary anode assembly 10 and the cathode shield 24, must be large enough to prevent an electrical short from occurring between the anode and the cathode.

Attempts to maintain an optional distance "s" may, however, give rise to other circumstances that can adversely affect the quality of the x-rays generated. For instance, some electrons from the electron stream 22 may have a primary impact upon face 20 of anode target 14 without producing any x-rays. These electrons can then rebound from face 20 of the anode target layer 14 and result in a secondary electron stream (designated at 30 in FIG. 1) that can impinge upon the anode substrate 12 portion of the anode. As noted, the substrate material that is used to construct the anode substrate 12 is a contaminating source of x-rays. As such, this secondary impact stream may result in the production of an errant x-ray beam (denoted at 32 in FIG. 1), the characteristics of which are often significantly different from the primary x-ray beam 26. As noted, the interaction between the errant beam and the primary beam can adversely affect the quality, the intensity and the focusing of the x-rays that are ultimately produced and released by the x-ray tube device 8, which can ultimately affect the quality of any resulting analyses obtained via the x-rays.

Preventing the formation of such errant x-ray signals has proven difficult. One approach has been to reduce the size of the x-ray device window to prevent the errant x-ray signal from exiting the device and interfering with the primary x-ray signal. However, this approach may also limit the amount of primary x-rays that can exit the x-ray device to an unacceptable level, and thus may not be a viable alternative for certain x-ray applications. Thus, there is a need in the art for a stationary anode assembly that overcomes the problems associated with electrons striking the anode substrate material and producing a low quality, errant x-ray. Moreover, any solution should not affect the overall quality and quantity of the primary x-ray signal that is emitted from the x-ray device.

BRIEF SUMMARY AND PRIMARY OBJECTS OF THE INVENTION

The present invention has been developed in response to the present state of the art, and in particular, in response to these and other problems and needs that have not been fully or completely solved by currently available stationary anode assemblies for use in connection with x-ray tubes. Thus, it is an overall object of the present invention to provide a stationary anode assembly configuration that improves the quantity and the quality of x-ray signals emitted from the x-ray tube device. Another objective is to provide a stationary anode that reduces the amount of secondary, or errant x-rays from being generated at the anode substrate portion of the anode assembly. Yet another overall object of the present invention is to provide a stationary anode assembly that has an anode target that has a unique geometric shape that functions to reduce the number of electrons that rebound from the target face to the anode substrate. Another object of the invention is to provide a stationary anode assembly having an anode target geometry that also functions to block, or "shadow" x-rays that are inadvertently generated at the target substrate from being emitted from the x-ray tube. Another object is to provide a stationary anode assembly having an anode target that causes rebounding electrons to be directed towards the centerline of the target, and away from the underlying anode substrate.

In summary, the foregoing and other objects are achieved with a stationary anode assembly that eliminates, or at least reduces, x-rays from being produced at the anode substrate, thereby improving the quality and intensity of the x-ray signal that is emitted from the x-ray tube device. Embodiments of the present invention utilize an anode target structure that not only provides a suitable target surface, but that also includes means for preventing rebounding electrons from striking the underlying anode substrate. Preferably, the target structure also functions to block or shadow the underlying substrate in a manner such that in the event that x-rays are produced at the substrate, at least some of them are precluded from escaping the x-ray tube. Moreover, other embodiments include means for directing rebounding electrons in a direction towards the center of the anode target surface, and thus away from the underlying substrate. Both features thereby prevent, or at least reduce, x-rays from being produced at the anode substrate, and thus help ensure that a higher quality x-ray signal is emitted from the x-ray tube device.

The present invention contemplates various target configurations and geometric shapes for providing the above functions. For example, in currently preferred embodiments the means for preventing rebounding electrons from striking the substrate is implemented by way of a target anode "overhang" structure. The overhanging structure extends out over the underlying substrate, and therefore functions so as to block many of the rebounding electrons from striking the substrate, and also functions to shadow at least some of the x-rays that are inadvertently produced at the substrate from reaching the window of x-ray device. While not required, the overhang is preferably constructed with smooth surfaces and without any sharp angles in the edges. This improves the x-ray generating characteristics of the target anode, and ensures that x-rays are properly focused and directed through a x-ray device window.

In other embodiments, the means for directing rebounding electrons in a direction towards the center of the anode target surface is implemented by way of an anode target surface that has a specific contour in relation to its exposure to the x-ray tube window. This contoured surface can have various geometric shapes, each of which has the advantage of causing target-collided electrons that have yet to generate an x-ray beam to rebound substantially toward the center line of the anode target surface and away from the underlying anode substrate.

In other preferred embodiments of the present invention, a target anode with an overhang portion is combined with an appropriately contoured target surface. This combination provides the advantage of intensifying the occurrence of x-ray beam-generating electrons that strike the target, while still diminishing the occurrence of rebounding electrons that strike the anode substrate and also shadowing any x-rays that are produced from reaching the window of x-ray device.

These and other objects, features and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is to be understood that the drawings are diagrammatic and schematic representations of presently preferred embodiments of the present invention, and are not limiting of the present invention nor are they necessarily drawn to scale.

Figure 1:
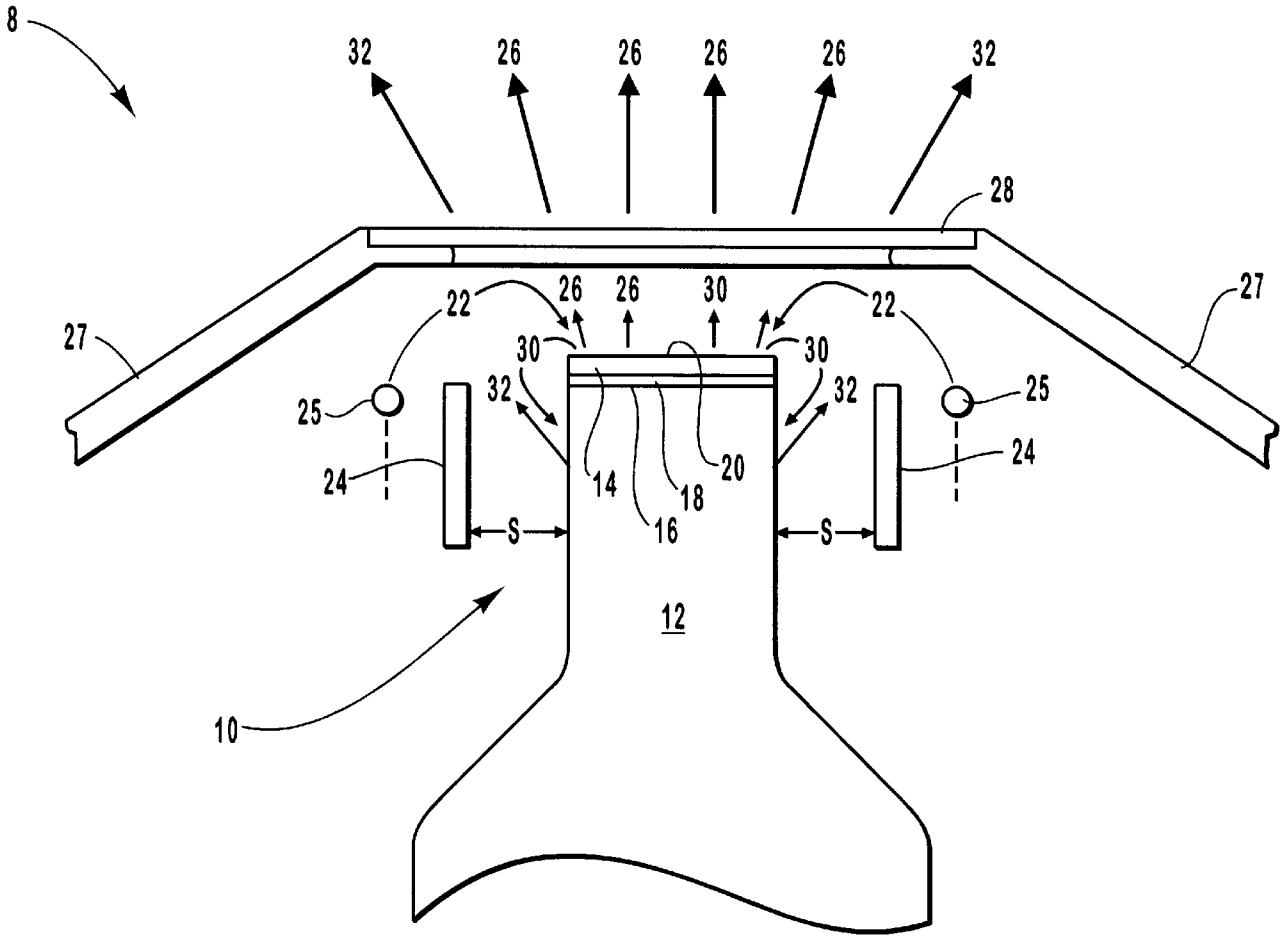
FIG. 1 (PRIOR ART)
FIG. 1 is an elevational cross-section view of a prior art x-ray device, wherein the anode is a stationary anode assembly with a target anode surface disposed upon one end of an anode substrate.
Figure 2:
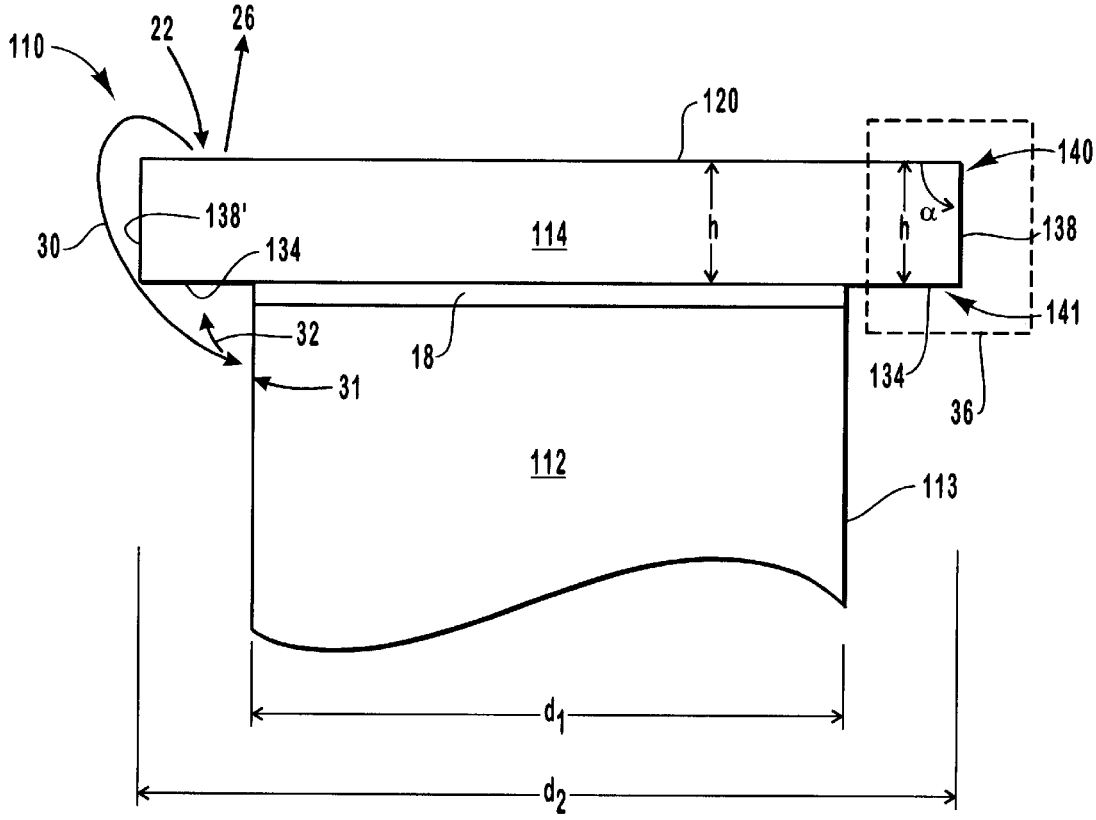
FIG. 2 is an elevational cross-section view of a presently preferred embodiment of a stationary anode assembly constructed in accordance with the teachings of the present invention.

Reference is first made to FIG. 2, which illustrates a cross-section elevational view of one preferred embodiment of a stationary anode assembly 110 constructed in accordance with the teachings of the present invention. As is shown, an anode target 114 portion is attached to the target end of an anode substrate 112. A brazing layer 18 or the like may be used to secure 114 to anode substrate 112.

As is shown, the anode target 114 provides a suitable target surface 120 upon which electrons emitted from the cathode (not shown) are impinged. In addition to providing a suitable target surface, the anode target 114 also includes target means for preventing at least some of the rebounding electrons from striking the underlying anode substrate 112, and for blocking x-rays that are generated at the substrate from exiting the x-ray tube. By way of example, and not limitation, the prevention means can be implemented by way of a target anode "overhang" portion, partially designated within detail box 36. As is shown, the overhang structure is formed as an integral part of the anode target 114 and in a manner such that it extends beyond at least a portion of the outer surface 113 of the adjacent anode substrate. Thus, as is shown in FIG. 2, the dimensions of the anode target 114 exceed those of the underlying substrate 112, and the outer periphery of the target 114 overhangs the anode substrate 112 creating an exposed underside portion 134. In FIG. 2, anode substrate 112 is illustrated as having a first diameter $d_1$, and anode target 114 as having a second diameter $d_2$. The first diameter $d_1$ corresponds to the width of the anode substrate 112, measured at its center cross-section, and second diameter $d_2$ corresponds to the width of the anode target 114, measured at its center cross-section from side 138' to the opposite side 138. Again, $d_2$ is greater than $d_1$ so that anode target 114 "overhangs" the anode substrate 112.

The overhanging feature of anode target 114 provides several advantages. First, at least some of the electrons that rebound after initial contact with the target surface 120 are "blocked" by the overhang from reaching the underlying substrate 112. Second, even when a rebounding electron does strike the anode substrate 112, and an errant x-ray is emitted, the overhang portion 36 functions to prevent the errant x-ray beam from exiting the x-ray tube. Instead, the errant x-ray beam 32 will tend to collide with exposed underside of target 134 and not become a part of the primary x-ray beam.

The particular values for $d_1$ and $d_2$ depend upon the application of the x-ray device, the heat dissipation requirements for anode target 114 and anode substrate 112, the proximity of filament 125 (not shown) to target 114, and upon the magnitude of the voltage potential that is applied between the anode target and the cathode (not shown). For instance, for certain applications target 114 may have a diameter $d_2$ that is double the size of $d_1$. However, it will be appreciated that $d_2$ may exceed the size of $d_1$ in different ratios, including from about 0.5% larger to about 50% larger. Preferably, $d_2$ may exceed the size of $d_1$ in a range from about 10% larger to about 20% larger.

Overhang portion 36 of target 114 has a height, designated as parameter h in FIG. 2, the value of which is chosen depending upon the requirements and operating parameters of the x-ray device, the anode target material, and the cost of the anode target material. The magnitude of h can be a range from about 125 mils to about 10 mils or less, and, preferably, is in a range from about 75 mils to about 50 mils. In one preferred embodiment, the height h of anode target 114 is about 60 mils.

The profile of the overhang portion 36 of target 114 includes an angle between the target face 120 and the side 138 so as to form edge 140. In FIG. 2, angle $\alpha$ is approximately 90° so as to form an overhang having a cross-section rectangular in shape. A lower edge 141 is also formed at the intersection between side 138 and exposed underside 134 of target 114.

Figure 3:
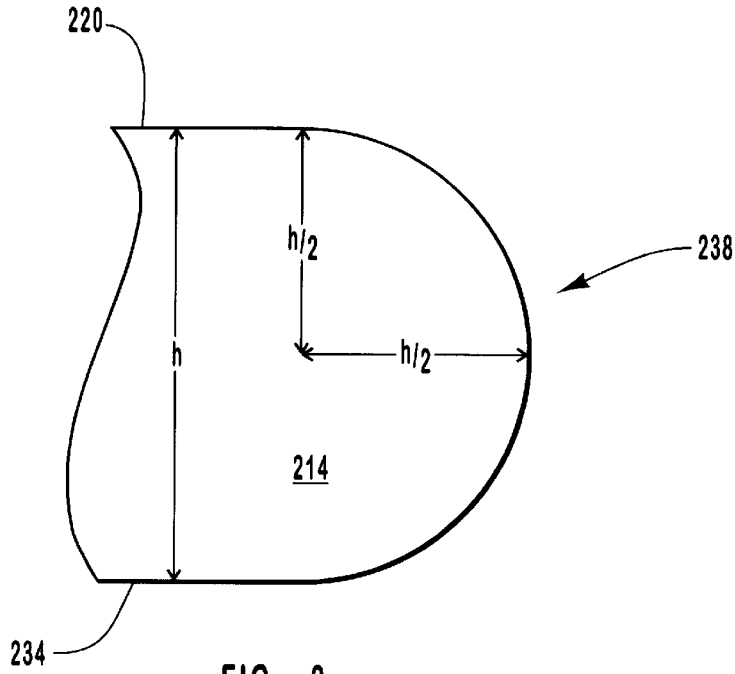
FIG. 3 is an elevational cross-section view of a detail of an embodiment of an anode target overhang, wherein the anode target has an edge that has a semi-circular profile.

In certain embodiments, a sharp edge 140 on the overhang portion, such as that shown in FIG. 2, is not desirable. An alternative is shown in FIG. 3, which illustrates a portion of anode target 214 corresponding to the overhang portion illustrated at area 36 in FIG. 2. In the embodiment of FIG.

3, the overhang section is formed without any sharp, acute angles or edges. More particularly, the thickness of target 214 is the value h, and the side 238 of target 214 is rounded in a full radial or semi-circular profile between the face 220 of target 214 and the exposed underside 234 of target 214. The formation of the full radial or semi-circular profile between face 220 of target 214 and exposed underside 234 of target 214 may be carried out by such techniques as molding, micromachining, combinations thereof, and the like. Alternatively, the semi-circular profile depicted in FIG. 3 may be approximated by a series of bevels that, when increased in frequency between face 220 and exposed underside 234, approach a full radial or semi-circular profile. Two bevels that eliminate edge 140 and lower edge 141 as seen in FIG. 2 may be used to the lowest approximate a full radial profile. Additionally, the actual profile need not be circular alone, and may instead include eccentric profiles such as parabolic and hyperbolic profiles.

Figure 4:
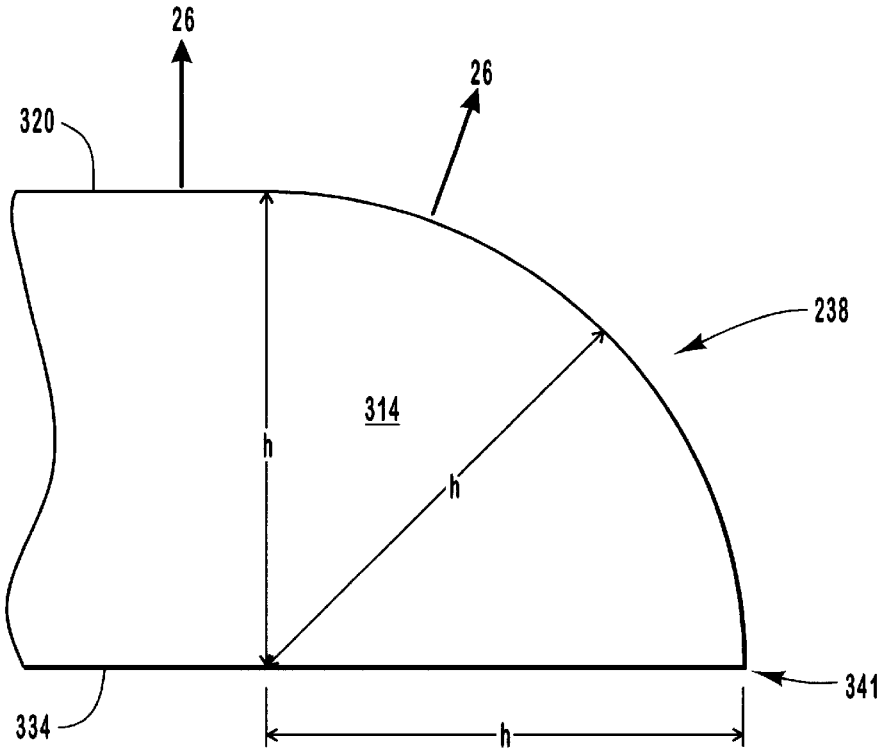
FIG. 4 is an elevational cross-section view of a detail of another embodiment of an anode target overhang, wherein the anode target has an edge that has a quarter-circular profile.

FIG. 4 illustrates another embodiment of the overhang portion of a target anode. In this embodiment, overhang portion of anode target 314 has a face 320 and a side 338 formed as a quarter-circular arc, having a radius h, that terminates at an exposed underside 334 of target 314. A lower edge 341 is formed at the conjunction of exposed underside 334 and side 338. Similar to the formation of the full radial or semi-circular profile in FIG. 3, the quarter-circular arc depicted in FIG. 4 may be formed by the same techniques including molding, micromachining, eccentric profiles, and a series of bevels that simulate the aforementioned profiles.

Figure 5:
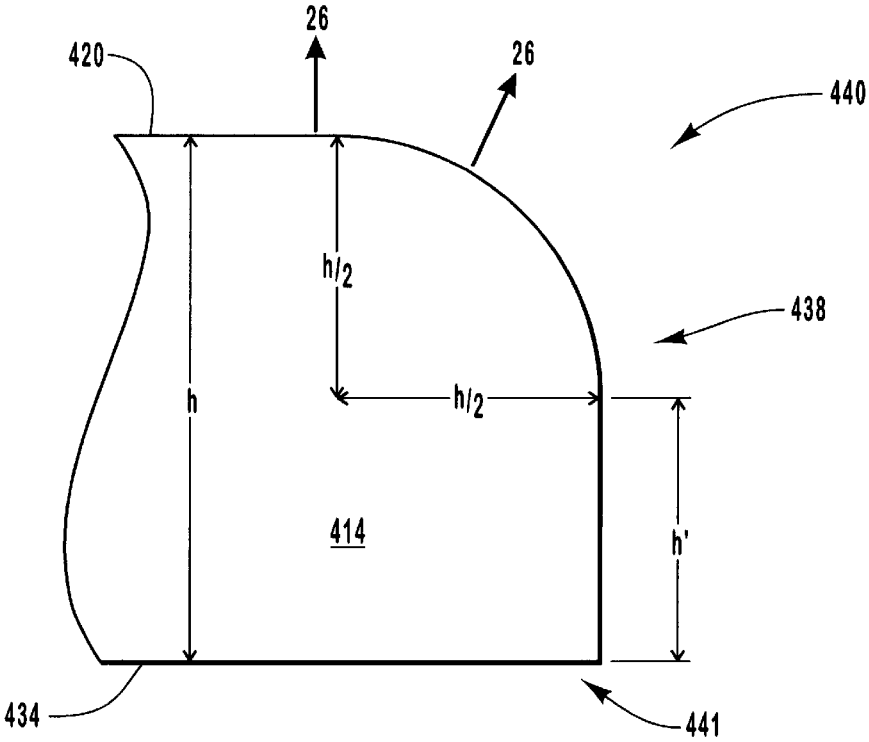
FIG. 5 is an elevational cross-section view of a detail of yet another embodiment of an anode target overhang, wherein the anode target has an edge that has a rectangular profile with a rounded edge.

FIG. 5 illustrates yet another embodiment of the present invention wherein the anode target 414 overhang portion (detail 36 in FIG. 2) is constructed with a different shape. As is shown, target anode 414 includes a face 420 having an edge 440 that has been truncated as a convex circular arc, which has a radius of h/2. Again, the value of the radius may be varied according to the particular application and may be smaller than h/2. In a preferred embodiment, where the radius of arc is h/2, the value designated at h' also has a value of h/2 such that the radius added to h' equals h. Again, the convex circular arc 440 may be made using techniques similar to those used to make the profiles depicted in FIGS. 3 and 4 including molding, micromachining, eccentric shapes, and a series of bevels approximating the convex circular arc.

Figure 6:
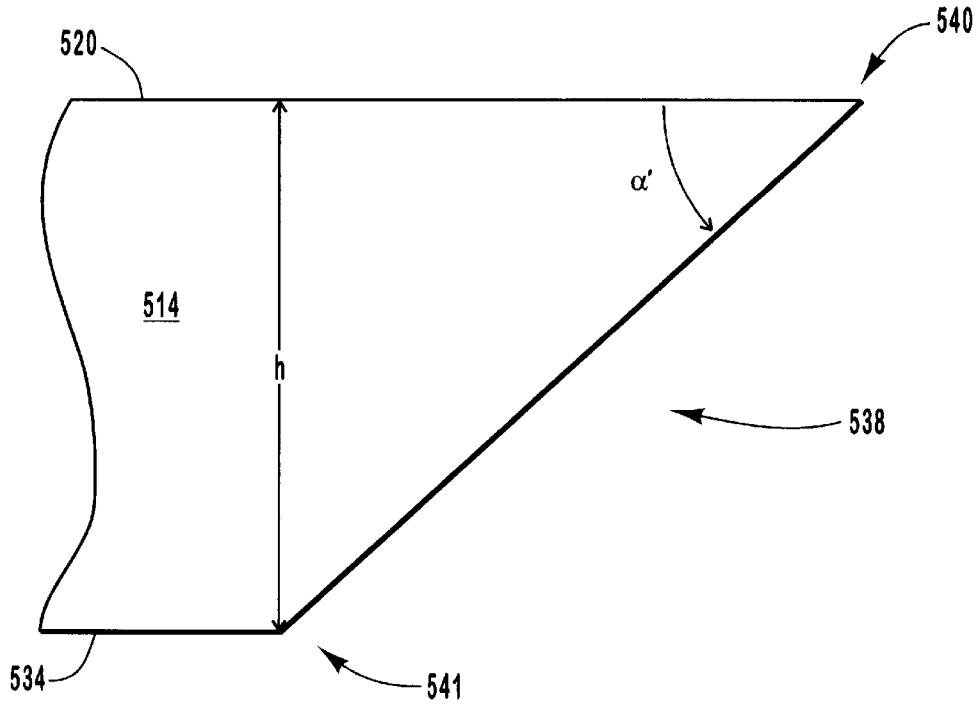
FIG. 6 is an elevational cross-section view of a detail of another embodiment of an anode target overhang, wherein the anode target has a triangular shaped edge.

FIG. 6 illustrates yet another embodiment of the overhanging portion of an anode target 514 corresponding to detail 36 in FIG. 2. In FIG. 6, a face 520 is formed with an edge with an acute-angle cross-sectional profile. An acute angle edge 540 is thereby formed, along with a side 538 that forms an acute angle $\alpha'$ with face 520.

Figure 7:
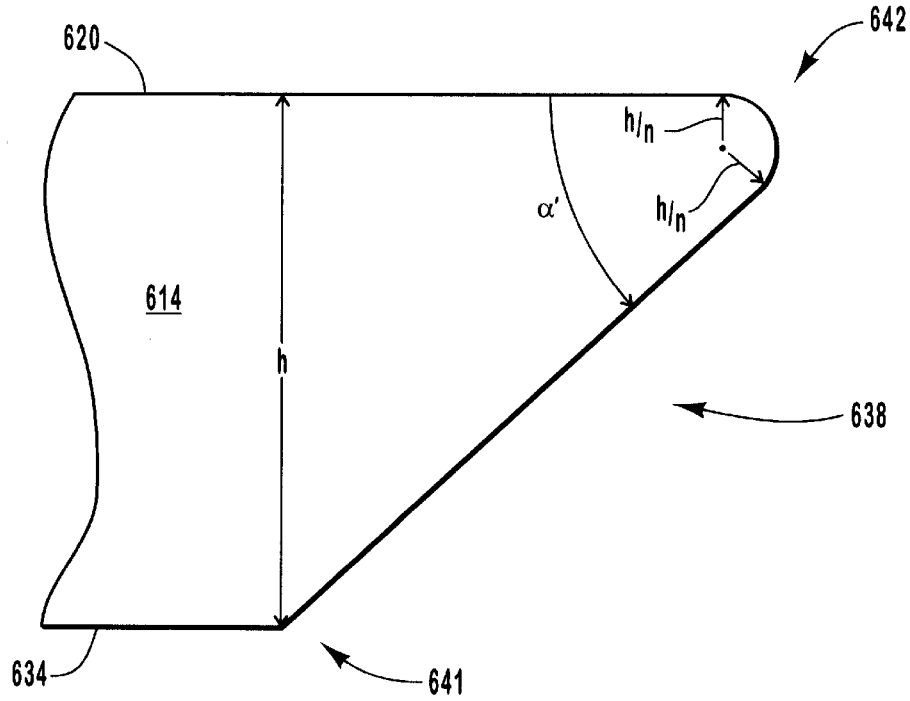
FIG. 7 is an elevational cross-section view of a detail of yet another embodiment of an anode target overhang, wherein the anode target has a triangular shape with a rounded tip.

FIG. 7 illustrates an alternative to the FIG. 6 embodiment. In particular, the acute angle edge 540 of FIG. 6 acute angle edge 642 is modified by rounding the edge. In a preferred embodiment, modified acute angle edge 642 has a radius h/n, wherein n may have a value of about 2 to 20. The modified acute angle edge 642 may be formed by molding, micromachining, eccentric profiles, and by a series of bevels that approach the required profile. Also, although in the embodiments illustrated in FIGS. 6 and 7 have a portion of the undersides 534, 634 exposed, the width $d_l$ of the anode substrate (see FIG. 2) may terminate at respective lower edges 541, 641 so as to completely cover the underside portions 534, 634.

The embodiments shown in FIGS. 2 through 7 illustrate how electrons may be prevented from rebounding and striking the underlying anode substrate, and how errant x-rays are blocked from exiting the x-ray tube, by way of an overhang portion on the anode target. However, the present invention contemplates other embodiments that include means for directing electrons that rebound from the target surface in a direction away from the underlying anode substrate—preferably towards the center of the target surface. Presently preferred examples of particular anode target structures for implemented this redirection means are described by making reference to FIGS. 8–10. In general, the means for directing rebounding electrons in a direction towards the center of the anode target surface are implemented by way of a characteristic contour formed on the anode target surface. In general, the contour is implemented in a manner so as to cause any electrons that do rebound, to deflect in a manner so as to re-strike the face of the anode target instead of the anode substrate as a secondary electron stream 30 (FIG. 2). In this way, rebounding electrons will simply strike the target surface in the intended manner, and thus contribute to the generation of useful x-rays. Preferably, the characteristic contour of the target surface is generally concave in its orientation towards the window of the x-ray device.

Figure 10:
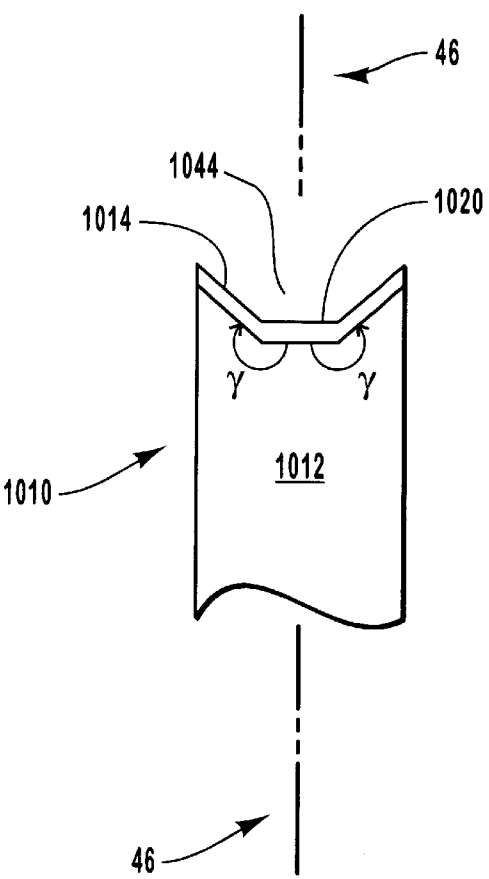
FIG. 10 is an elevational cross-section view of yet another embodiment of an anode assembly, wherein the anode target has a surface having congruent concave contours that form a frusto conical depression.
Figure 9:
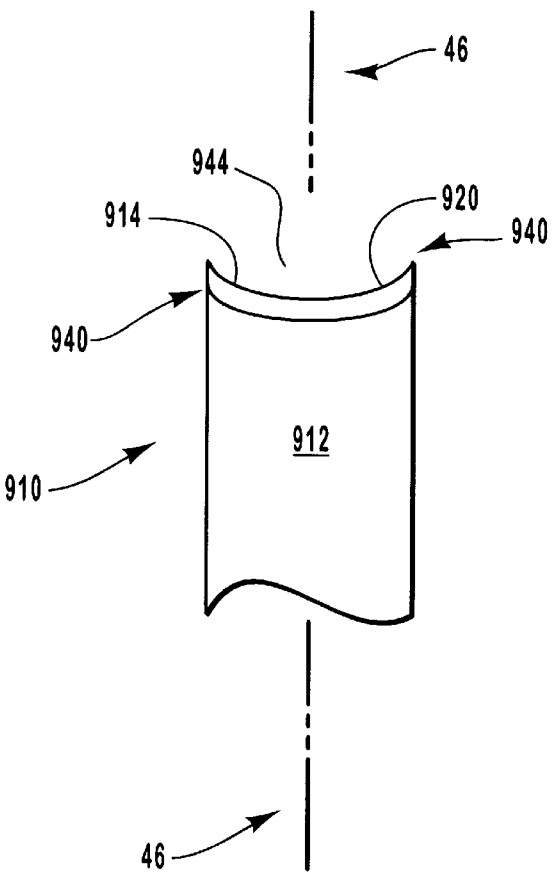
FIG. 9 is an elevational cross-section view of another embodiment of an anode assembly, wherein the anode target has a surface having congruent concave contours that form a curvilinear depression.
Figure 8:
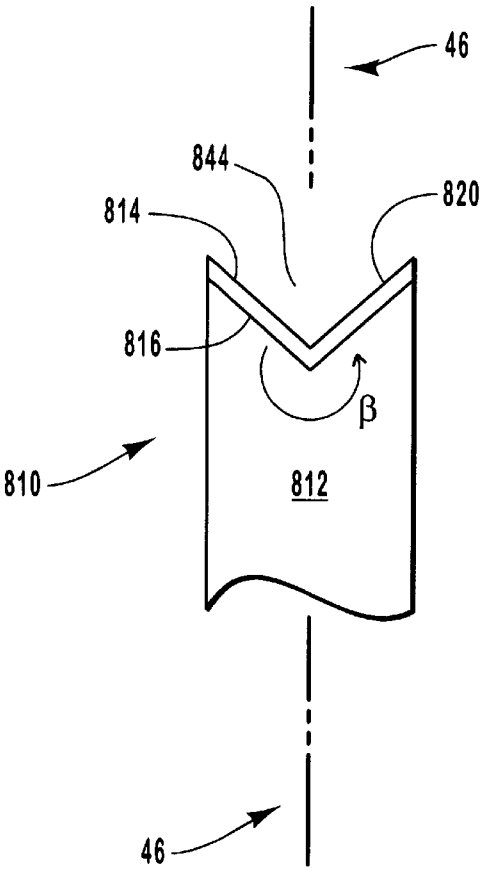
FIG. 8 is an elevational cross-section view of one preferred embodiment of an anode assembly, wherein the anode target has a surface having congruent concave contours that form a conical depression.

FIGS. 8–10 illustrate embodiments where the diameter of the anode target $d_2$ and the underlying anode substrate $d_l$ are substantially equal. In FIG. 8 the anode target 814 is disposed upon the anode substrate 812 in the manner previously described. In cross-section, the stationary anode assembly 810 appears to have an anode target 814 surface having a contour formed as a depression 844 that has a V-shaped profile. This depression 844 is the displacement of a cone shape, the angle of which is defined by angle $\beta$. Angle $\beta$, may be an acute angle or an obtuse angle, is preferably less than 180°, and optimally is in a range from about 170° to about 20°. The mid-line 46 of stationary anode assembly 810 substantially bisects target 814 and anode substrate 812 at the apex of angle $\beta$. In this configuration, electrons that strike the face 820 of target anode 814 without generating an x-ray will tend to rebound in a manner so as to re-strike target 814, and not in a direction that would result in a secondary impact at anode substrate 812. The surface configuration thus functions in a manner so that the generation of errant x-ray beam 32 (FIG. 2) is substantially avoided.

FIG. 9 illustrates yet another embodiment where the target surface is oriented to prevent electrons from striking the anode substrate. There, anode assembly 910 is configured with an anode target 914 having a surface 920 that is formed as a substantially curvilinear depression 944. Generally, any preferred curvilinear depression, viewed in cross-section, may be used depending upon the particular application. For example, the depression may be formed as a circular arc, a parabolic arc, a hyperbolic arc, and the like. In the embodiment of FIG. 9, depression 944 is substantially circular when viewed in cross-section and actually is formed in a shape that would be caused by the displacement of a spheroidal object. Alternatively, depression 944 may have a dish shape such that the face 920 of target 914 near mid-line 46 is substantially planar, and as the profile approaches the edge 940, the face 920 bends into a concave arc that meets at edge 940. Accordingly, such profiles for face 920 may be a combination of a planar section and a curvilinear section such as a concave quarter-circular arc, a rectangular edge truncated by a concave arc, and the like. Similar shapes could also be used. Also, the edge 940 formed by surface 920, as well as the edges formed by anode targets depicted in FIGS. 8 and 10, may be rounded in accordance with the teachings of the above embodiments.

FIG. 10 illustrates yet another preferred embodiment utilizing a target surface 1020 that functions to reduce rebounding electrons from striking the underlying anode substrate. In FIG. 10, target surface 1020 is formed as a depression 1044 in a form that would result from the displacement of a frusto-conical body. In the illustrated embodiment, depression 1044 is defined by two obtuse angles each of which have the value of $\gamma$. The value of $\gamma$ is preferably less than 180°, and may be in the range of between about 90° to up to slightly less than about 180°.

Figure 13:
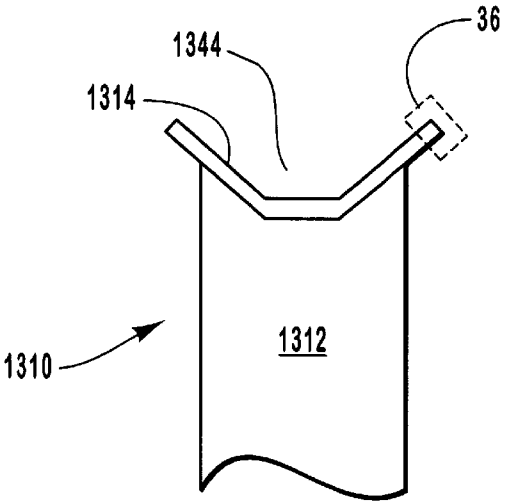
FIG. 13 is an elevational cross-section view of yet another stationary anode assembly, wherein the anode target has a surface having congruent concave contours that form a frusto conical depression and wherein the target has a characteristic dimension that is greater than the characteristic dimension of the anode substrate at the target end.
Figure 12:
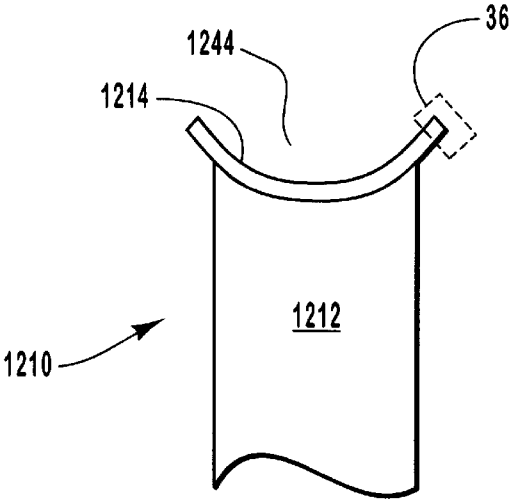
FIG. 12 is an elevational cross-section view of another anode assembly, wherein the anode target has a surface having congruent concave contours that form a curvilinear depression and wherein the target has a characteristic dimension that is greater than the anode substrate at the target end.
Figure 11:
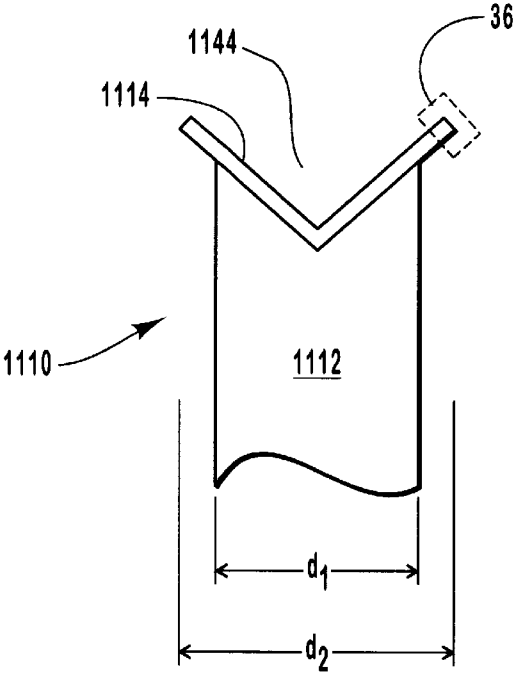
FIG. 11 is an elevational cross-section view of an example of a preferred anode assembly, wherein the anode target has a surface having congruent concave contours that form a conical depression, and wherein the anode target has a characteristic dimension greater than the anode substrate at the target end.

FIGS. 11, 12 and 13 are additional alternative embodiments of the present invention, which utilize a combination of an overhanging target and a characteristic target surface contour to enhance the prevention of errant x-ray beam 32. For instance, in each of these figures a first diameter $d_l$ of anode substrate (1112, 1212, 1312), is shown as having a dimension that is smaller than a second diameter, $d_2$ of anode target (1114, 1214, 1314), thereby forming an overhanging target as previously discussed. In addition, as is denoted at detail area 36, each of the embodiments depicted in FIGS. 2–7 can also be used in the embodiments of FIGS. 11–13. Finally, each embodiment includes a target depression configuration (1144, 1244, 1344) for directing rebounding electrons towards the center of the target surface. A particular application of combination face, side, and unexposed underside depends upon the degree of overhang, the diameter of the window in relation to the diameter of the target and the particular needs for the applied x-rays.

Figure 14:
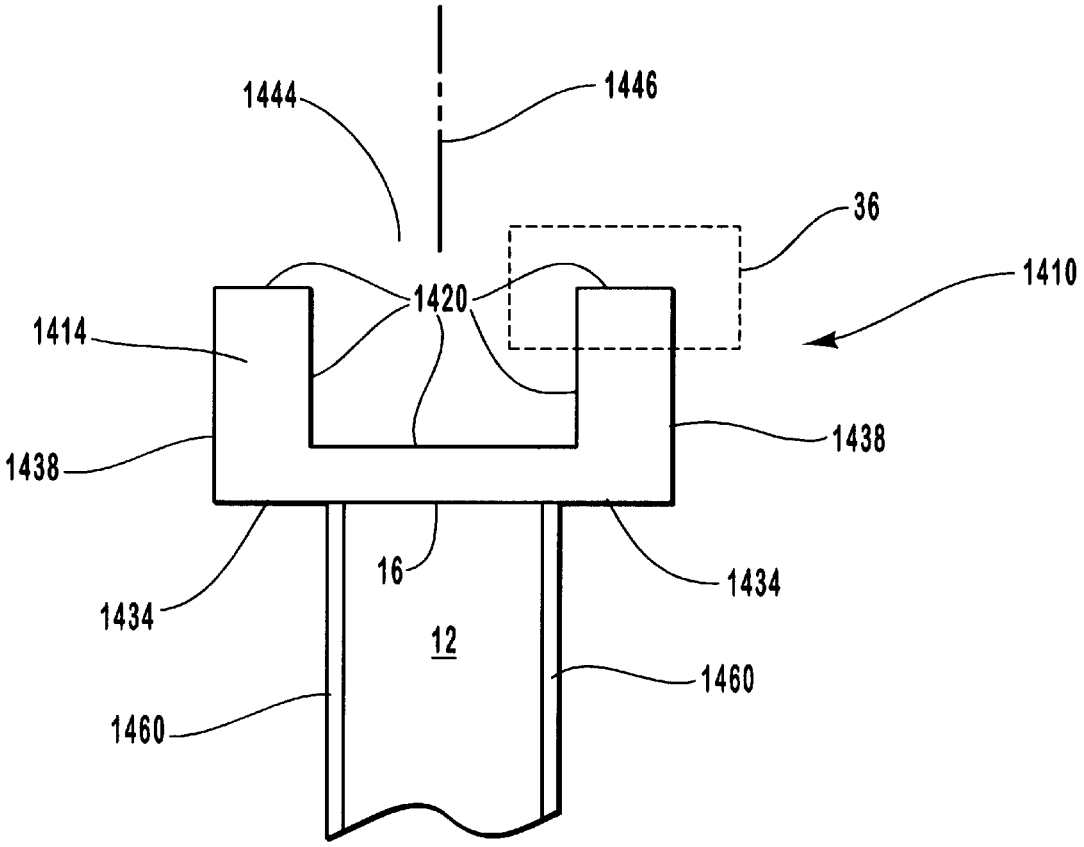
FIG. 14 is an elevational cross-section view of another stationary anode assembly, wherein the target forms a depression that would be the displacement formed by a solid cylinder.

FIG. 14 illustrates yet another embodiment of the present invention. Here, target face 1420 has five distinct surfaces or more. The application of alternative embodiments taken from detail 36 in FIGS. 2–7, may modify the number of distinct surfaces of face 1420 such that its number varies as many as nine distinct surfaces and six potential sharp edges to a single smooth surface that begins at face 1420 at the mid-line 1446 and, proceeding radially in opposite directions, ends at the exposed underside 1434 of target 1414.

FIG. 14 also illustrates an additional means by which the production of errant x-rays from the anode substrate may be reduced, and which may be included with any of the previous embodiments. As is shown in FIG. 14, a thin layer of anode target material (i.e., a high Z material) is placed onto the outer surface of anode substrate to form a microsheath 1460. In the illustrated embodiment, microsheath 1460 is made of the same material as target 1414, although different materials could be used. Microsheath 1460 may have a thickness in a range from about 10 Angstroms to about 10,000 Angstroms, and in one preferred embodiment is about 50 Angstroms. Microsheath 1460 is preferably formed upon a stationary anode assembly as a final step in the assembly process, and may be applied using any suitable means such as by chemical vapor deposition (CVD). Microsheath 1460 is one example of a means for reducing the production of errant x-rays. As will be appreciated from the foregoing discussion, in the event that a rebounding electron does strike the anode substrate, and is not sufficiently blocked, the microsheath layer 1460 ensures that any x-rays produced are similar in quality (i.e., wave length) as those formed at the target surface.

The target anode of the present invention may be made from a large variety of materials such as titanium and tungsten, or any similar metallic material that is an efficient generator of x-rays when impinged with high velocity electrons. Preferably, the target is made of rhodium, platinum, or molybdenum, or chromium, or tungsten, or titanium. In the case of a dual target, split filament device, the target can be made with a combination such as a rhodium-chromium or rhodium-tungsten dual target.

In many x-ray tubes, the anode substrate is typically made of copper or an alloy thereof because of its low cost and high thermal conductivity, although other materials could be used. Because the target is typically made of specific atomic number materials, the atomic number of the target, is typically different than the atomic number of the substrate. Where the substrate is an alloy, it is understood that the atomic number is a weighted average of the atomic numbers of the alloy components. For instance, in an exemplary embodiment, the anode substrate has the atomic number different than that of copper and the anode target surface has an atomic number equal to one of the metals including rhodium, platinum, molybdenum, chromium, titanium or tungsten or combinations thereof.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A stationary anode assembly for use in an x-ray tube, the stationary anode assembly comprising:

an anode substrate structure having an outer surface, the anode substrate structure being comprised of a material having first atomic number;

an anode target structure affixed to a target end of the anode substrate structure, the anode target structure having a target surface that is comprised of a material having a second atomic number that is different than the first atomic number; and an anode target overhang formed as a part of the anode target structure in a manner so as to extend beyond the outer surface of the anode substrate.

2. A stationary anode assembly according to claim 1, wherein the anode target overhang has an edge that has a rectangular profile.

3. A stationary anode assembly according to claim 1, wherein the anode target overhang has a rectangular profile and wherein at least one corner of the overhang is rounded.

4. A stationary anode assembly according to claim 1, wherein the anode target overhang has an edge having a semi-circular profile.

5. A stationary anode assembly according to claim 1, wherein the anode target overhang has an edge having a triangular profile.

6. A stationary anode assembly according to claim 1, wherein the anode target structure further comprises means for directing a rebounding electron in a direction substantially towards the center of the anode target.

7. A stationary anode assembly according to claim 6, wherein the means for directing a rebounding electron is comprised of a contoured surface formed on the anode target.

8. A stationary anode assembly according to claim 7, wherein the contoured surface formed on the anode target is substantially concave in shape.

9. A stationary anode assembly according to claim 7, wherein the contoured surface formed on the anode target has a profile in the form of a circular arc.

10. A stationary anode assembly according to claim 7, wherein the contoured surface formed on the anode target has a profile in the form of a parabolic arc.

11. A stationary anode assembly according to claim 7, wherein the contoured surface formed on the anode target has a profile in the form of a cone.

12. A stationary anode assembly according to claim 1, wherein the anode substrate further comprises means for reducing the production of errant x-rays resulting from the impact of rebounding electrons.

13. A stationary anode assembly according to claim 12, wherein the means for reducing the production of errant x-rays is comprised of a layer of material placed on at least a portion of the outer surface of the anode substrate, the layer of material being comprised of a metal having an atomic number equal to that of the material used in the anode target.

14. A stationary anode assembly comprising:

an anode substrate having a target end, wherein the target end has and a first diameter that is bounded by an outer surface; and an anode target disposed upon the target end of the anode substrate, wherein the anode target has a second diameter that is greater than the first diameter, whereby the anode target extends beyond the outer surface of the substrate.

15. An anode assembly as defined in claim 14, wherein the anode substrate is comprised of a material having a first atomic number, and wherein the anode target is comprised of a material having a second atomic number that is different from the first atomic number.

16. An anode assembly according to claim 15, wherein the second atomic number is greater than the first atomic number.

17. An anode assembly according to claim 14, wherein the anode target further comprises a target surface having a convex contour.

* * * * *

UNITED STATES PATENT AND TRADEMARK OFFICE

CERTIFICATE OF CORRECTION

PATENT NO. : 6,393,099 B1
APPLICATION NO. : 09/409998
DATED : May 21, 2002
INVENTOR(S) : Miller It is certified that error appears in the above-identified patent and that said Letters Patent is hereby corrected as shown below:

Column 11
Line 16: after "has" delete "and"

Signed and Sealed this

Fourteenth Day of December, 2010

David J. Kappos

David J. Kappos
*Director of the United States Patent and Trademark Office*